US005267540A

United States Patent [19]

Zerrer et al.

[11] Patent Number: 5,267,540

[45] Date of Patent: Dec. 7, 1993

[54] PULL-ROPE STARTER FOR AN INTERNAL COMBUSTION ENGINE

[75] Inventors: Gerhard Zerrer; Igor Klaric, both of Korb, Fed. Rep. of Germany

[73] Assignee: Andreas Stihl, Waiblingen, Fed. Rep. of Germany

[21] Appl. No.: 943,475

[22] Filed: Sep. 11, 1992

[30] Foreign Application Priority Data

Sep. 11, 1991 [DE] Fed. Rep. of Germany ... 9111276[U]

[51] Int. Cl.[5] ..... F02N 3/02

[52] U.S. Cl. ..... 123/185.3

[58] Field of Search ..... 123/185.3, 185.2, 185.4

[56] References Cited

U.S. PATENT DOCUMENTS

| | | | |
|---|---|---|---|
| 2,374,685 | 5/1945 | Kissel et al. | 123/185.3 |
| 2,564,787 | 8/1951 | Mack | 123/185.3 |
| 4,492,190 | 1/1985 | Greenwood et al. | 123/185.3 |

*Primary Examiner*—Andrew M. Dolinar
*Attorney, Agent, or Firm*—Walter Ottesen

[57] ABSTRACT

The invention is directed to a pull-rope starter for an internal combustion engine of a portable handheld work apparatus such as a motor-driven chain saw, cutoff machine or the like. The work apparatus has a housing defining cooling air openings for conducting cooling air and the pull-rope starter includes a rope disc rotatably journalled in the housing in the region of the cooling air openings. A carrier is disposed adjacent the rope disc and seated in the housing so as to close a space in the housing for accommodating a spiral spring mounted on the carrier. The carrier is so configured that its outer periphery is greater than the rope disc. The carrier has a wall section on its side facing toward the rope disc and this wall section extends essentially over the width of the rope slot and over essentially the entire periphery of the rope disc. The rope slot and the pull rope accommodated therein are in this way covered with respect to the cooling-air flow so that dirt particles and abrasive dust entrained in the cooling-air flow cannot settle in the rope slot. The mechanical stress on the pull rope is reduced and the resistance to wear of the pull-rope starter is increased.

7 Claims, 4 Drawing Sheets

PULL-ROPE STARTER FOR AN INTERNAL COMBUSTION ENGINE

BACKGROUND OF THE INVENTION

Pull-rope starters are known wherein the pull-rope starter is mounted in the housing of a work apparatus in the region of the cooling-air passages so that dirt and abrasive dust entrained in the cooling air can deposit in the slot of the rope disc. This ultimately leads to a considerable mechanical stress on the rope and therefore increases the wear thereof.

SUMMARY OF THE INVENTION

It is an object of the invention to provide a pull-rope starter which substantially prevents the deposit of dirt particles entrained in the cooling air in the slot of the rope disc.

The pull-rope starter of the invention is for an internal combustion engine of a portable handheld work apparatus such as a motor-driven chain saw, cutoff machine or the like. The work apparatus has a housing defining cooling air openings for conducting cooling air and the pull-rope starter includes: a rope disc disposed in the housing in the region of the cooling air openings; bearing means for rotatably journalling the rope disc in the housing; the housing defining a mounting space; a carrier disposed adjacent the rope disc and seated in the housing so as to close the space in the manner of a cover; a spiral spring mounted on the carrier and being disposed in the space between the housing and the rope disc; the spiral spring having a first end fixedly connected to the housing and a second end attached to the rope disc; the carrier having a diameter greater than the diameter of the rope disc and having a side facing toward the rope disc; and, the carrier having a wall section formed on the side so as to extend essentially over the width of the rope disc and to extend over at least a portion of the periphery of the rope disc.

The carrier is so configured that its outer periphery is larger than the rope disc. The carrier has a wall section on its side facing toward the rope disc. This wall section extends essentially over the width of the rope slot and over essentially the entire periphery of the rope disc. The rope slot and the pull rope accommodated therein are in this way covered with respect to the cooling-air flow so that dirt particles and abrasive dust entrained in the cooling-air flow cannot settle in the rope slot. The mechanical stress on the pull rope is thereby reduced whereby the resistance to wear of the pull-rope starter is increased.

In a preferred embodiment, the wall section extends above the entire height of the rope disc and is preferably somewhat higher. In this way, the dirt and abrasive dust depositing at the edge of the wall section deposits next to the rope slot and does not penetrate into the slot.

The wall section advantageously extends over a peripheral angle of 320° and delimits a rope outlet between its ends. The rope outlet opens especially directly into a housing opening for passing the pull rope to the outside. In this way, the rope outlet is disposed substantially outside of the cooling air guide so that an entry of dirt and abrasive dust into the rope slot is prevented even in the region of the rope outlet.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
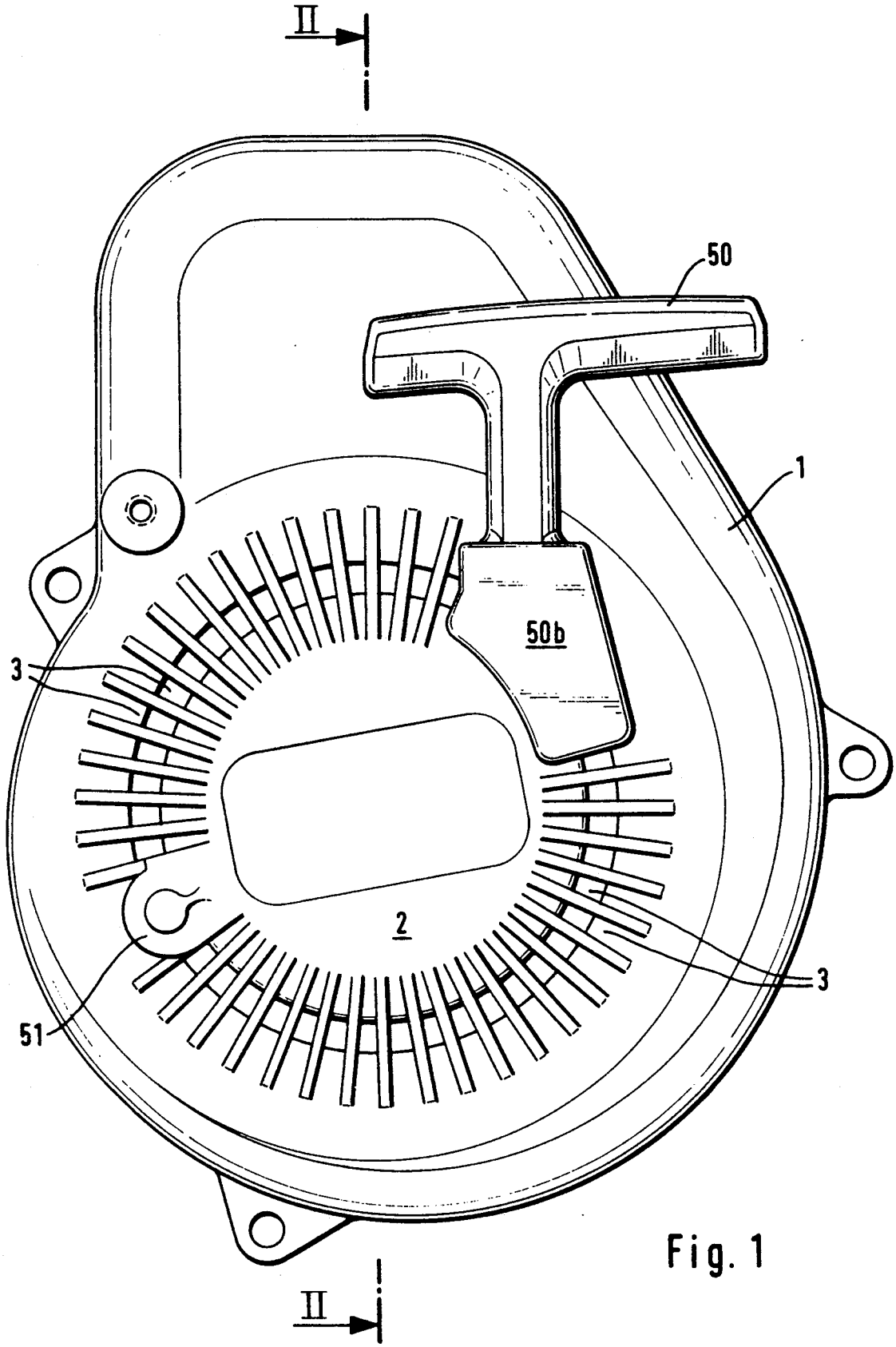
FIG. 1 is a plan view of a housing cover having cooling-air inlets and an integrated pull-rope starter.

The housing cover 1 shown in FIG. 1 covers a cooling-air blower which guides the necessary cooling air for an internal combustion engine mounted in a housing. The internal combustion engine is that of a portable handheld work apparatus such as a motor-driven chain saw, cutoff machine, brushcutter or the like.

The housing cover 1 has a pot-shaped dome 2 having a side wall wherein a plurality of cooling-air inlet openings 3 are disposed. These cooling-air inlet openings extend over the periphery of the dome 2.

Figure 2:
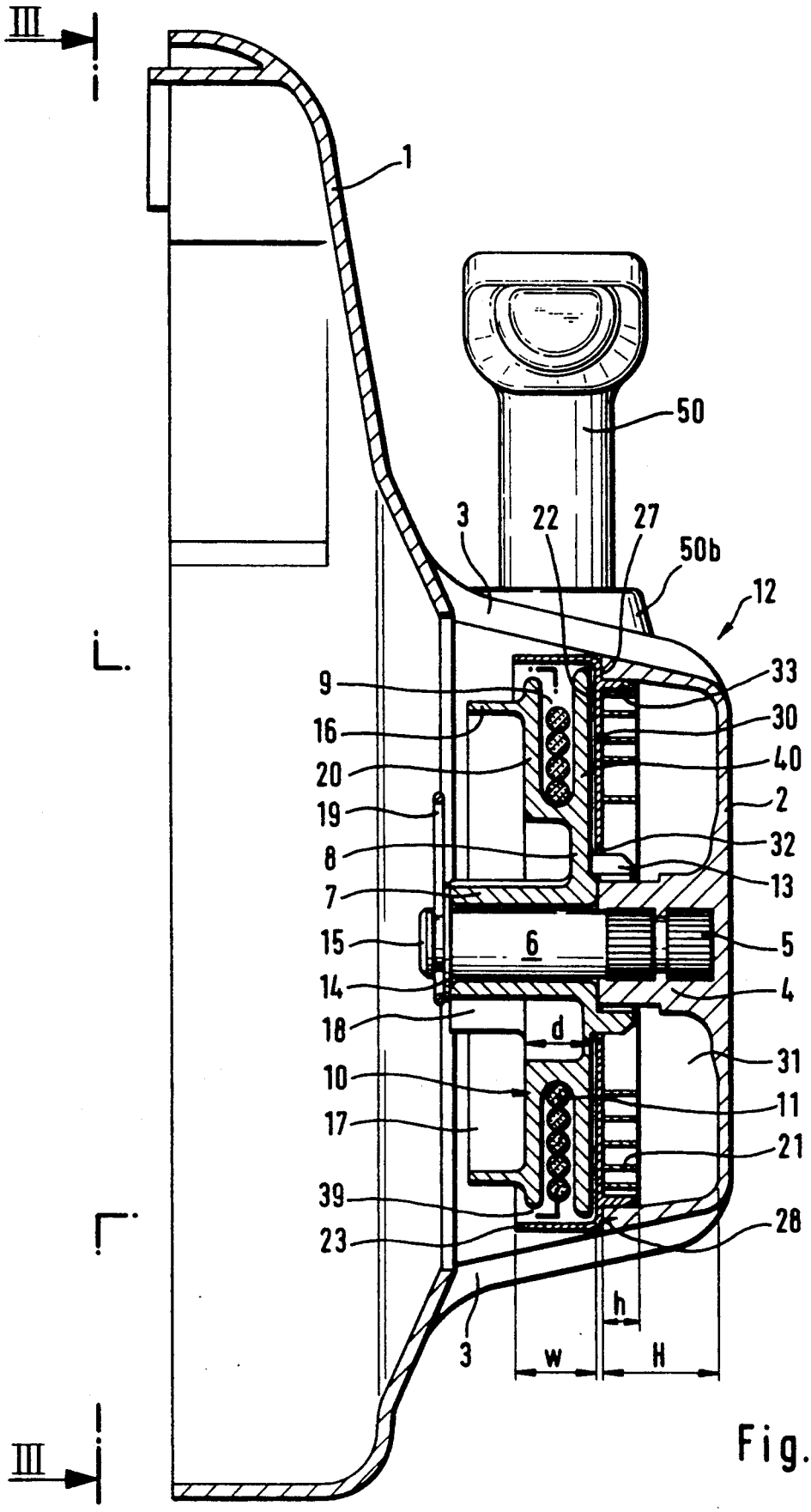
FIG. 2 is a section view taken along line II—II of FIG. 1.

The roof of the dome 2 has a central cylindrical projection 4 projecting inwardly as shown in FIG. 2. The foot 5 of a bearing pin 6 is fixedly held in the projection 4so that it cannot rotate. The foot 5 of the pin is embedded during the injection molding process with the injected material engaging into the foot 5 so that the bearing pin 6 is axially fixed.

The bearing pin 6 is perpendicular to the cover of the dome 2. A hub 7 is rotatably mounted on the bearing pin 6 and has a disc carrier 8 at the end of the hub facing toward the projection 4. A rope disc 10 is fixedly connected to the hub 7 so as to rotate therewith. The rope disc 10 has a rope slot 9 which is open outwardly in the radial direction wherein the pull rope 11 of a pull-rope starter 12 is accommodated.

The disc carrier 8 is provided with an annular wall 13 facing toward the top wall of the dome 2. The annular wall 13 is perpendicular to the disc carrier 8 and extends over the cylindrical projection 4 of the dome 2. The end of the hub 7 facing toward the top wall of the dome 2 has an end face. The hub braces itself with this end face against the end face of the projection 4 which lies opposite thereto. At its other end, the end face of the hub 7 lies against an intermediate disc 14 which is axially secured by a screw 15 rotated axially into the bearing pin 6. The hub 7 is so held that it cannot be axially separated from the bearing pin 6 and is held so as to be rotatable on this bearing pin.

The annular wall 20 of the rope disc 10 delimits the rope slot 9 and has an end facing away from the projection 4. At this end, the annular wall 20 carries an annular wall 16 which extends approximately to the head of the attachment screw 15. The annular wall 16 together with the rope disc 10, the disc carrier 8 and the hub 7 conjointly define a clutch drum 17 which extends over a correspondingly configured counterpiece on one end of the crankshaft of the internal combustion engine. A spring 19 is held friction-tight on the head of the attachment screw 15. The hub 7 carries coupling elements 18 which coact with the spring 19 and latch on the coupling counterpiece on the crankshaft when actuating the pull-rope starter and in this way start the engine. When the engine starts to run, the coupling elements 18 are returned by the coupling counterpiece.

The hub 7, the disc carrier 8, the rope disc 10 and the annular walls 13 and 20 conjointly define a complete component preferably made of plastic.

A spiral spring 21 is mounted in the dome 2 between the rope disc 10 and the housing cover 1. The spiral spring 21 rotates the rope disc 10 as a return spring for the pull rope 11. The spiral spring 21 is mounted on a carrier 30 which closes the receiving space 31 in the form of a cover. The receiving space 31 is delimited by the top wall area of the cover 2. The height H of the receiving space 31, measured in the axial direction of the bearing pin 6, corresponds approximately to the height of the projection 4.

Figure 5:
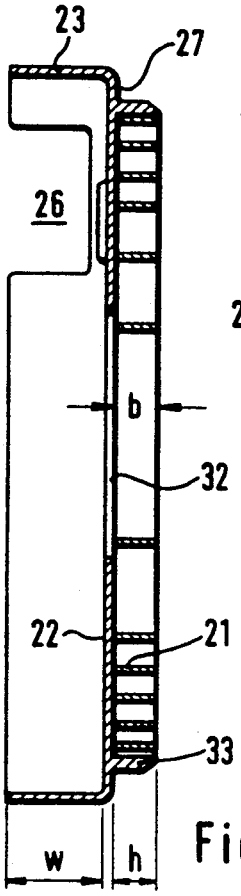
FIG. 5 is a section view taken along line V—V of FIG. 4.
Figure 4:
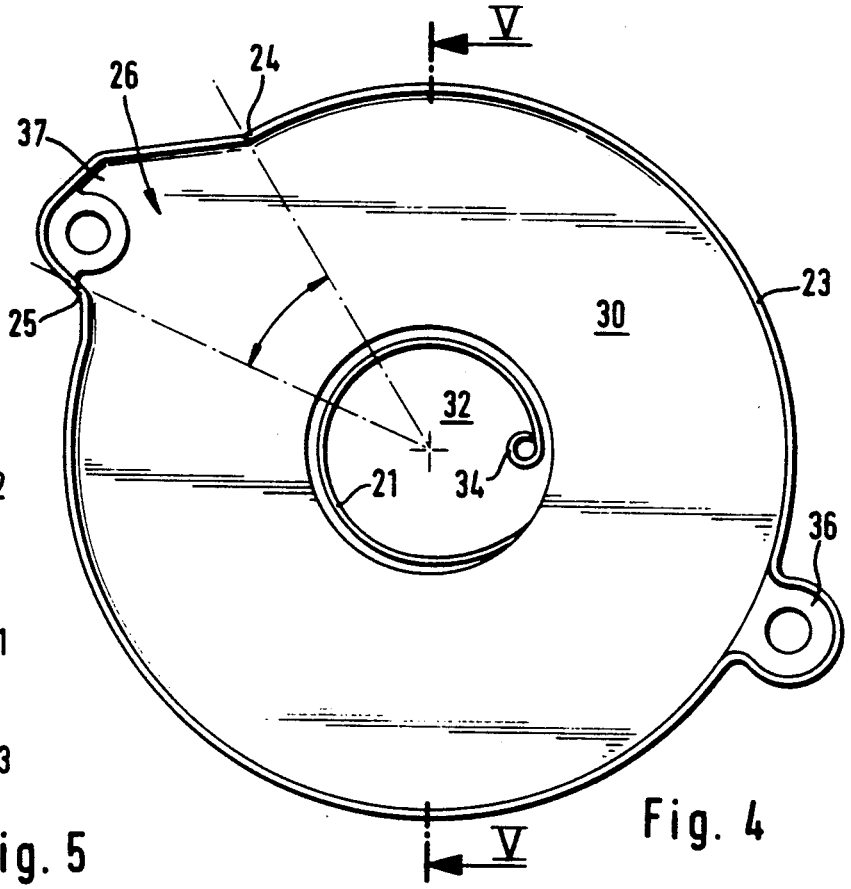
FIG. 4 is a plan view of a carrier for a spiral spring of the pull-rope starter which coacts with the rope disc.
Figure 6:
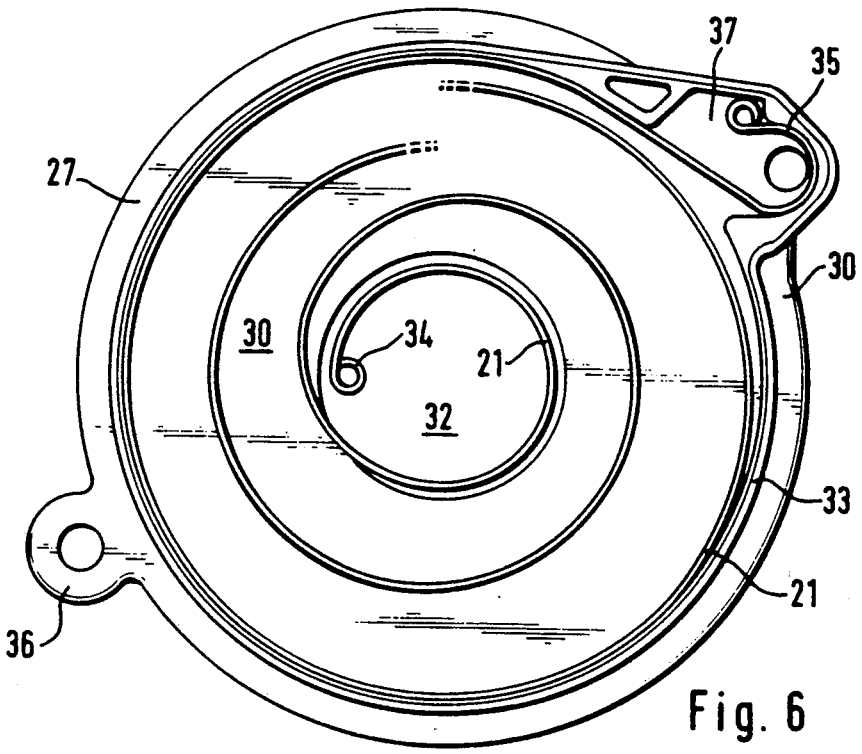
FIG. 6 is a plan view of the carrier with the spiral spring mounted thereon.

The carrier 30 is shown in FIGS. 4 to 6. The carrier 30 includes a central opening 32 through which the annular wall 13 of the disc carrier 8 projects into the receiving space 31. The carrier 30 has a peripheral edge 33 facing toward the receiving space 31. The peripheral edge 33 has a height (h) which corresponds to the width (b) of the spiral spring 21. The spiral spring 21 is therefore held in the cover-like carrier 30 in the form of a cassette. The inner end 34 of the spiral spring 21 is fixed on the annular wall 13 of the disc carrier 8; whereas, the outer end 35 of the spiral spring 21 is fixed on the carrier 30.

Figure 3:
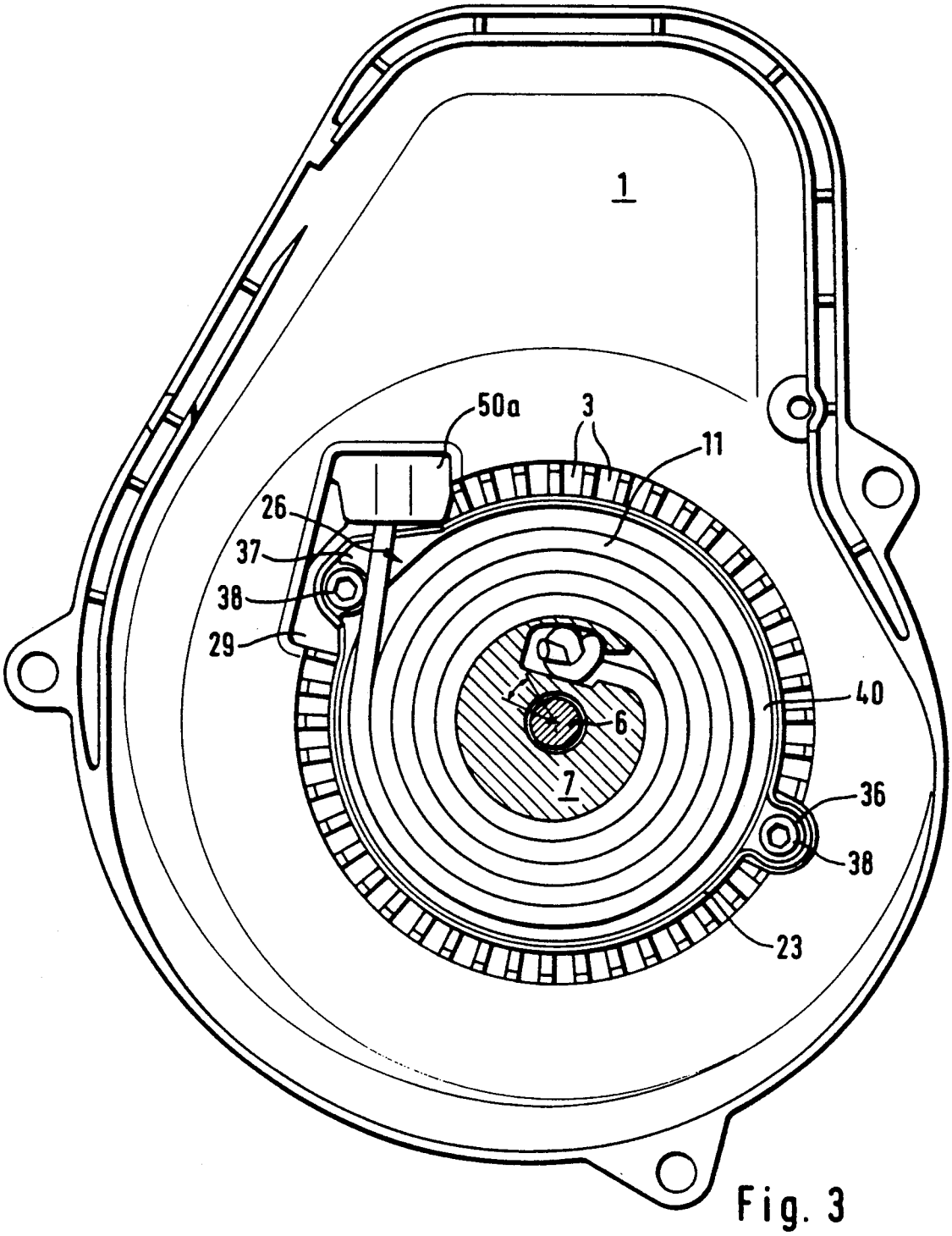
FIG. 3 is a section view along line III—III of FIG. 2.

As shown in FIG. 3, the carrier 30 includes a pair of attachment lugs (36, 37) which lie approximately diametrically opposite each other. The attachment lugs (36, 37) are fixed in the housing cover 1 by means of attachment screws 38. The attachment lug 37 is then disposed in a housing opening 29 of the cover 1 through which the pull rope 11 is passed to a handle 50 lying on the outside.

The foot 50*a* of the handle 50 is held in the housing opening 29 in such a manner that the handle 50 lies on the dome 2 in its rest position so as to be tangential to the rope disc 10 as shown in FIG. 1. For this purpose, a projection 50*b* forming the housing opening 29 is provided on the dome 2 with the projection 50*b* interrupting the circle of the air-inlet openings 3. Diametrically opposite the projection 50*b*, the circle of air-inlet openings 3 is interrupted once again by an attachment base 51.

The carrier 30 closes the receiving space 31 in the form of a cover and has an outer diameter greater than the outer diameter of the rope disc 10. The carrier 30 also carries a wall section 23 on its end 22 facing toward the rope disc 10. The wall section 23 covers the rope slot 9 essentially over most of its periphery.

In the embodiment shown, the wall section 23 has a height (w) greater than the thickness (d) of the rope disc 10. The wall section 23 thereby projects beyond the annular wall 20 which faces away from the carrier 30 and delimits the rope slot 9.

As shown in FIGS. 3 and 4, the wall section 23 extends over a peripheral angle of the rope slot 9 of approximately 320°. The ends 24 and 25 of the wall section 23 delimit a rope outlet 26. If the carrier 30 is securely mounted on the housing as shown in FIG. 3, the rope outlet 26 opens directly into the housing opening 29 so that the rope exiting from the rope outlet 26 tangentially to the rope disc 10 can be led directly through the housing opening 29 to the handle 50.

The attachment lug 37 is disposed in the region of the rope outlet 26 so that the attachment screw 38 passing through the attachment lug 37 can be screwed into the housing projection 50*b* of the dome 2. Correspondingly, the attachment screw 38 of the attachment lug 36 is screwed into the attachment base 51 of the housing cover 1. The outer end 35 of the spiral spring 21 advantageously engages around the attachment screw 38 inserted through the attachment lug 37 whereby a reliable attachment to the housing is provided. As shown in FIG. 6, the peripheral edge 33 of the carrier 30 extends into the region of the attachment lug 37 and in this way also surrounds the outer end 35 of the spiral spring 21 which is fixed to the housing.

In the same way, the wall section 23 continues on the other side 22 of the carrier 30 in the region of the attachment lug 36 and surrounds the attachment screw 38 which is disposed radially within the wall section 23.

The carrier 30, the wall section 23 and the surrounding edge 33 facing toward the dome 2 are manufactured as a single component made of plastic.

An annular shoulder 27 is formed on the carrier 30 between the inner peripheral wall 33 and the outer wall section 23. The annular shoulder 27 lies against a correspondingly configured annular support 28 of the dome 2 whereby the receiving space 31 is closed off in the manner of a cover. The inner peripheral wall 33 then lies flush against the dome wall as shown in FIG. 2.

In order to close the rope slot 9 by means of the wall section 23 as completely as possible, the radial play between the wall section 23 and the rope disc 10 is dimensioned as tight as possible. The pretensioning of the spiral spring 21 is adjusted for a pull-rope starter mounted in a housing cover 1 so that one or more rope turns can be put into the rope slot 9 or can come out without rotating the rope disc 10. For this purpose, the annular wall 20 of the rope slot 9 facing away from the carrier 30 has an outer diameter less than the annular wall 40 of the rope slot 9 facing toward the carrier whereby an annular gap 39 is formed between the annular wall 20 and the wall section 23. The pull rope 11 can be introduced into the rope slot 9 axially through the annular gap 39.

It is understood that the foregoing description is that of the preferred embodiments of the invention and that various changes and modifications may be made thereto without departing from the spirit and scope of the invention as defined in the appended claims.

What is claimed is:

1. A pull-rope starter for an internal combustion engine of a portable handheld work apparatus such as a motor-driven chain saw, cutoff machine or the like, the work apparatus having a housing defining cooling air openings for conducting cooling air, the pull-rope starter comprising:

a rope disc disposed in said housing in the region of said cooling air openings;

bearing means for rotatably journalling said rope disc in said housing;

said housing defining a mounting space;

a carrier disposed adjacent said rope disc and seated in said housing so as to close said space in the manner of a cover;

a spiral spring mounted on said carrier and being disposed in said space between said housing and said rope disc;

said spiral spring having a first end fixedly connected to the housing and a second end attached to said rope disc;

said carrier having a diameter greater than the diameter of said rope disc and having a side facing toward said rope disc;

said carrier having a wall section formed on said side so as to extend essentially over the width of said rope disc and to extend over at least a portion of the periphery of said rope disc;

said wall section extending over a portion of the periphery of said rope disc; and, said wall section having first and second ends conjointly defining a rope outlet for the rope on said rope disc;

said housing having a pass-through opening formed therein to communicate with said rope outlet so as to permit the rope to pass out of the housing; and, said carrier having attachment lugs and said pull-rope starter further comprising fastening screws passing through said lugs for fixedly attaching said carrier to said housing.

2. The pull-rope starter of claim 1, said attachment lugs being disposed on diametrically opposite sides of said carrier.

3. The pull-rope starter of claim 2, one of said attachment lugs being disposed in said pass-through opening.

4. The pull-rope starter of claim 3, the fastening screw of said one attachment lug being radially within said wall section.

5. The pull-rope starter of claim 1, said wall section extending over a portion of the periphery of said rope disc corresponding to a peripheral angle of approximately 320°.

6. A pull-rope starter for an internal combustion engine of a portable handheld work apparatus such as a motor-driven chain saw, cutoff machine or the like, the work apparatus having a housing defining cooling air openings for conducting cooling air, the pull-rope starter comprising:

a rope disc disposed in said housing in the region of said cooling air openings;

bearing means for rotatably journalling said rope disc in said housing;

said housing defining a mounting space;

a carrier disposed adjacent said rope disc and seated in said housing so as to close said space in the manner of a cover;

a spiral spring mounted on said carrier and being disposed in said space between said housing and said rope disc;

said spiral spring having a first end fixedly connected to the housing and a second end attached to said rope disc;

said carrier having a diameter greater than the diameter of said rope disc and having a side facing toward said rope disc;

said carrier having a wall section formed on said side so as to extend essentially over the width of said rope disc and to extend over at least a portion of the periphery of said rope disc; and, said rope disc having first and second annular walls conjointly defining a rope slot; said first annular wall facing away from said carrier and said second annular wall facing toward said carrier; and, said first annular wall having a diameter less than said second annular wall.

7. The pull-rope starter of claim 6, said wall section extending beyond the height (d) of said rope disc.

* * * * *